US007367176B1

(12) United States Patent
Gilmore et al.

(10) Patent No.: US 7,367,176 B1
(45) **Date of Patent: *May 6, 2008**

(54) WRAPPED YARNS FOR USE IN ROPES HAVING PREDETERMINED SURFACE CHARACTERISTICS

(75) Inventors: Justin Gilmore, New Iberia, LA (US); David E. O'Neal, Lafayette, LA (US); Danielle D. Stenvers, Ferndale, WA (US); Chia-Te Chou, Bellingham, WA (US); Ronald L. Bryant, Lafayette, LA (US); Eric W. McCorkle, Bellingham, WA (US)

(73) Assignee: Samson Rope Technologies, Ferndale, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/599,817

(22) Filed: Nov. 14, 2006

Related U.S. Application Data

(63) Continuation of application No. 10/903,130, filed on Jul. 30, 2004, now Pat. No. 7,134,267.

(60) Provisional application No. 60/530,132, filed on Dec. 16, 2003.

(51) Int. Cl.
*D02G 3/02* (2006.01)

(52) U.S. Cl. ..... 57/237

(58) Field of Classification Search ..... 57/210, 57/237, 244

See application file for complete search history.

(56) References Cited

U.S. PATENT DOCUMENTS

| | | | | |
|---|---|---|---|---|
| 3,367,095 | A | 2/1968 | Field, Jr. | |
| 4,947,917 | A | 8/1990 | Noma et al. | |
| 5,802,839 | A | 9/1998 | Van Hook | |
| 5,822,791 | A | 10/1998 | Baris | |
| 6,876,798 | B2 | 4/2005 | Triplett et al. | |
| 6,945,153 | B2 | 9/2005 | Knudsen et al. | |
| 7,134,267 | B1 * | 11/2006 | Gilmore et al. | 57/237 |
| 2007/0079695 | A1 * | 4/2007 | Bucher et al. | 87/8 |

* cited by examiner

*Primary Examiner*—Shaun R. Hurley
(74) *Attorney, Agent, or Firm*—Michael R. Schacht; Schacht Law Office, Inc.

(57) ABSTRACT

A rope and method of making the same. The rope is adapted to engage a structural member and comprises a plurality of yarns. At least one of the yarns comprises a first set of first fibers and a second set of fibers. The first and second sets of fibers are combined using a false twisting process such that the second fibers do not extend the length of the rope and the second fibers indirectly bear tension loads on the rope. The first fibers substantially determine load bearing properties of the rope. The second fibers substantially determine abrasion resistance properties and a coefficient of friction of the rope. Abrasion resistance properties of the second fibers are greater than abrasion resistance properties of the first fibers. A coefficient of friction of the second fibers is less than a coefficient of friction of the first fibers.

22 Claims, 5 Drawing Sheets

WRAPPED YARNS FOR USE IN ROPES HAVING PREDETERMINED SURFACE CHARACTERISTICS

RELATED APPLICATIONS

This application is a Continuation of U.S. Ser. No. 10/903,130 filed Jul. 30, 2004, now U.S. Pat. No. 7,134,267, which claims benefit of U.S. Provisional Application Ser. No. 60/530,132, which was filed on Dec. 16, 2003. The contents of all related applications listed above are incorporated herein by reference.

TECHNICAL FIELD

The present invention relates to rope systems and methods and, in particular, to wrapped yarns that are combined to form strands for making ropes having predetermined surface characteristics.

BACKGROUND OF THE INVENTION

The characteristics of a given type of rope determine whether that type of rope is suitable for a specific intended use. Rope characteristics include breaking strength, elongation, flexibility, weight, and surface characteristics such as abrasion resistance and coefficient of friction. The intended use of a rope will determine the acceptable range for each characteristic of the rope. The term "failure" as applied to rope will be used herein to refer to a rope being subjected to conditions beyond the acceptable range associated with at least one rope characteristic.

The present invention relates to ropes with improved surface characteristics, such as the ability to withstand abrasion or to provide a predetermined coefficient of friction. Typically, a length of rope is connected at first and second end locations to first and second structural members. Often, the rope is supported at one or more intermediate locations by intermediate structural surfaces between the first and second structural members. In the context of a ship, the intermediate surface may be formed by deck equipment such as a closed chock, roller chock, bollard or bit, staple, bullnose, or cleat.

When loads are applied to the rope, the rope is subjected to abrasion where connected to the first and second structural members and at any intermediate location in contact with an intermediate structural member. Abrasion and heat generated by the abrasion can create wear on the rope that can affect the performance of the rope and possibly lead to failure of the rope. In other situations, a rope designed primarily for strength may have a coefficient of friction that is too high or low for a given use.

The need thus exists for improved ropes having improved surface characteristics, such as abrasion resistance or coefficient of friction; the need also exists for systems and methods for producing such ropes.

RELATED ART

U.S. Pat. No. 3,367,095 to Field, Jr, discloses a process and apparatus for making wrapped yarns. The wrapped yarn of the '095 patent comprises a core formed of continuous fibers and a wrapping formed of discontinuous fibers. The '095 patent generally teaches that all synthetic and natural fibers including metal, glass, and asbestos may be used to form the core and wrapping but does not specify particular combinations of such materials for particular purposes.

SUMMARY OF THE INVENTION

The present invention may be embodied as a rope adapted to engage a structural member. The rope comprises a plurality of yarns, where at least one of the yarns comprises first and second sets of fibers. The first fibers extend the length of the rope such that the first fibers directly bear tension loads applied to the rope. The first and second sets of fibers are combined using a false twisting process. The second fibers do not extend the length of the rope. The second fibers indirectly bear tension loads on the rope. When the rope contacts the structural member, the second set of fibers is primarily in contact with the structural member. The first fibers substantially determine load bearing properties of the rope. The second fibers substantially determine abrasion resistance properties of the rope, where abrasion resistance properties of the second fibers are greater than abrasion resistance properties of the first fibers. The second fibers substantially determine a coefficient of friction between the rope and the structural member, where a coefficient of friction of the second fibers is less than a coefficient of friction of the first fibers.

The present invention may also be embodied as a method of forming a rope adapted to engage a structural member comprising the following steps. First and second sets of fibers are combined using a false twisting process to form a rope. The first fibers extend the length of the rope. The second fibers do not extend the length of the rope. The second fibers at least partly surround the first fibers. The first fibers directly bear tension loads applied to the rope and substantially determine load bearing properties of the rope. When the rope contacts the structural member, the second set of fibers is primarily in contact with the structural member. The second fibers thus substantially determine abrasion resistance properties of the rope, and abrasion resistance properties of the second fibers are greater than abrasion resistance properties of the first fibers. The second fibers also substantially determine a coefficient of friction between the rope and the structural member, where a coefficient of friction of the second fibers is less than a coefficient of friction of the first fibers.

DETAILED DESCRIPTION OF THE INVENTION

Figure 1A:
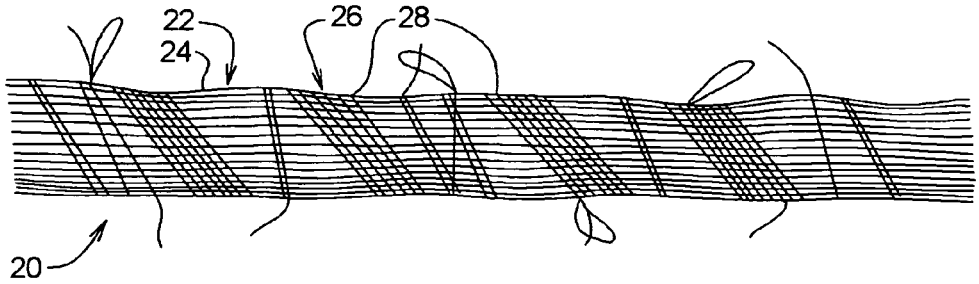
FIG. 1A is a side elevation view of a wrapped yarn that may be used to construct a rope of the present invention.
Figure 1B:
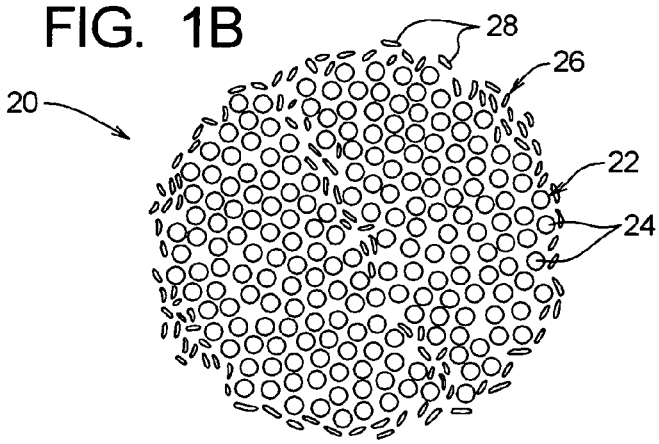
FIG. 1B is an end elevation cutaway view depicting the yarn of FIG. 1A.

Referring initially to FIGS. 1A and 1B of the drawing, depicted therein is a blended yarn 20 constructed in accordance with, and embodying, the principles of the present invention. The blended yarn 20 comprises at least a first set 22 of fibers 24 and a second set 26 of fibers 28.

The first and second fibers 24 and 28 are formed of first and second materials having first and second sets of operating characteristics, respectively. The first material is selected primarily to provide desirable tension load bearing characteristics, while the second material is selected primarily to provide desirable abrasion resistance characteristics.

In addition to abrasion resistance, the first and second sets of operating characteristics can be designed to improve other characteristics of the resulting rope structure. As another example, certain materials, such as HMPE, are very slick (low coefficient of friction). In a yarn consisting primarily of HMPE as the first set 22 for strength, adding polyester as the second set 26 provides the resulting yarn 20 with enhanced gripping ability (increased coefficient of friction) without significantly adversely affecting the strength of the yarn 20.

The first and second sets 22 and 26 of fibers 24 and 28 are physically combined such the first set 22 of fibers 24 is at least partly surrounded by the second set 26 of fibers 28. The first fibers 24 thus form a central portion or core that is primarily responsible for bearing tension loads. The second fibers 28 form a wrapping that at least partly surrounds the first fibers 24 to provide the rope yarn 20 with improved abrasion resistance.

The example first fibers 24 are continuous fibers that form what may be referred to as a yarn core. The example second fibers 28 are discontinuous fibers that may be referred to as slivers. The term "continuous" indicates that individual fibers extend along substantially the entire length of the rope, while the term "discontinuous" indicates that individual fibers do not extend along the entire length of the rope.

As will be described below, the first and second fibers 24 and 28 may be combined to form the example yarn using a wrapping process. The example yarn 20 may, however, be produced using process for combining fibers into yarns other than the wrapping process described below.

With the foregoing understanding of the basic construction and characteristics of the blended yarn 20 of the present invention in mind, the details of construction and composition of the blended yarn 20 will now be described.

The first material used to form the first fibers 24 may be any one or more materials selected from the following group of materials: HMPE, is LCP, or PBO fibers. The second material used to form the second fibers 28 may be any one or more materials selected from the following group of materials: polyester, nylon, Aramid, LCP, and HMPE fibers.

The first and second fibers 24 and 28 may be the same size or either of the fibers 24 and 28 may be larger than the other. The first fibers 24 are depicted with a round cross-section and the second fibers 28 are depicted with a flattened cross-section in FIG. 1B for clarity. However, the cross-sectional shapes of the fibers 24 and 28 can take forms other than those depicted in FIG. 1B. The first fibers 24 are preferably generally circular. The second fibers 28 are preferably also generally circular.

The following discussion will describe several particular example ropes constructed in accordance with the principles of the present invention as generally discussed above.

FIRST ROPE EXAMPLE

Figure 2:
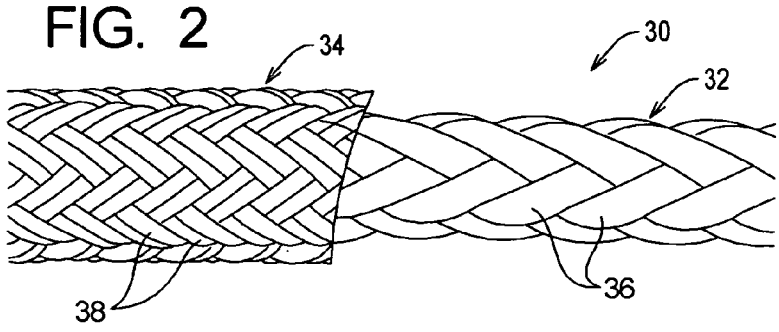
FIG. 2 is a side elevation view of a first example of a rope of the present invention.
Figure 3:
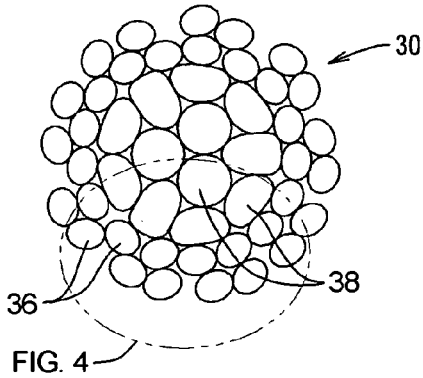
FIG. 3 is a radial cross-section of the rope depicted in FIG. 2.
Figure 4:
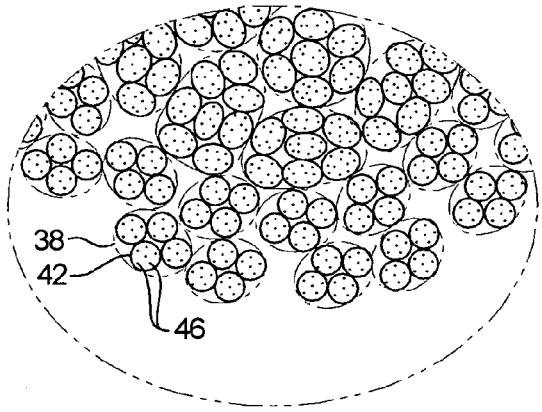
FIG. 4 is a close-up view of a portion of FIG. 3.

Referring now to FIGS. 2, 3, and 4, those figures depict a first example of a rope 30 constructed in accordance with the principles of the present invention. As shown in FIG. 2, the rope 30 comprises a rope core 32 and a rope jacket 34. FIG. 2 also shows that the rope core 32 and rope jacket 34 comprise a plurality of strands 36 and 38, respectively. FIG. 4 shows that the strands 36 and 38 comprise a plurality of yarns 40 and 42 and that the yarns 40 and 42 in turn each comprise a plurality of fibers 44 and 46, respectively.

One or both of the example yarns 40 and 42 may be formed by a yarn such as the abrasion resistant yarn 20 described above. However, because the rope jacket 34 will be exposed to abrasion more than the rope core 32, at least the yarn 42 used to form the strands 38 should be fabricated at least partly from the abrasion resistant yarn 20 described above.

The exemplary rope core 32 and rope jacket 34 are formed from the strands 36 and 38 using a braiding process. The example rope 30 is thus the type of rope referred to in the industry as a double-braided rope.

The strands 36 and 38 may be substantially identical in size and composition. Similarly, the yarns 40 and 42 may also be substantially identical in size and composition. However, strands and yarns of different sizes and compositions may be combined to form the rope core 32 and rope jacket 34.

As described above, fibers 44 and 46 forming at least one of the yarns 40 and 42 are of two different types. In the yarn 40 of the example rope 30, the fibers 44 are of a first type corresponding to the first fibers 24 and a second type corresponding to the second fibers 28. Similarly, in the yarn 42 of the example rope 30, the fibers 46 are of a first type corresponding to the first fibers 24 and a second type corresponding to the second fibers 28.

SECOND ROPE EXAMPLE

Figure 5:
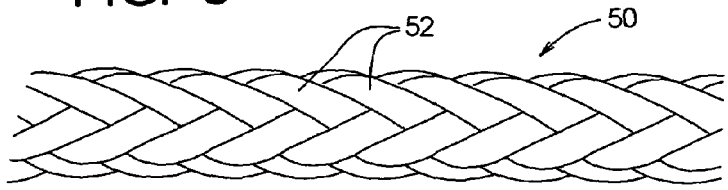
FIG. 5 is a side elevation view of a second example of a rope of the present invention.
Figure 6:
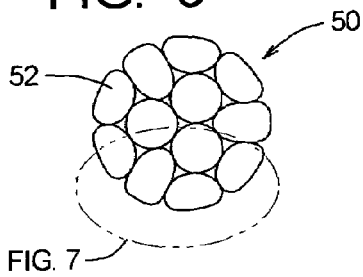
FIG. 6 is a radial cross-section of the rope depicted in FIG. 5.
Figure 7:
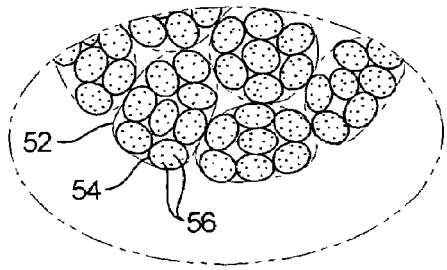
FIG. 7 is a close-up view of a portion of FIG. 6.

Referring now to FIGS. 5, 6, and 7, those figures depict a second example of a rope 50 constructed in accordance with the principles of the present invention. As perhaps best shown in FIG. 6, the rope 50 comprises a plurality of strands 52. FIG. 7 further illustrates that each of the strands 52 comprises a plurality of yarns 54 and that the yarns 54 in turn comprise a plurality of fibers 56.

The example yarn 54 may be formed by a yarn such as the abrasion resistant yarn 20 described above. In the yarn 54 of the example rope 50, the fibers 56 are of a first type corresponding to the first fibers 24 and a second type corresponding to the second fibers 28.

The strands 52 are formed by combining the yarns 54 using any one of a number of processes. The exemplary rope 50 is formed from the strands 52 using a braiding process. The example rope 50 is thus the type of rope referred to in the industry as a braided rope.

The strands 52 and yarns 54 forming the rope 50 may be substantially identical in size and composition. However, strands and yarns of different sizes and compositions may be combined to form the rope 50. The first and second types of fibers combined to form the yarns 54 are different as described above with reference to the fibers 24 and 28.

THIRD ROPE EXAMPLE

Figure 8:
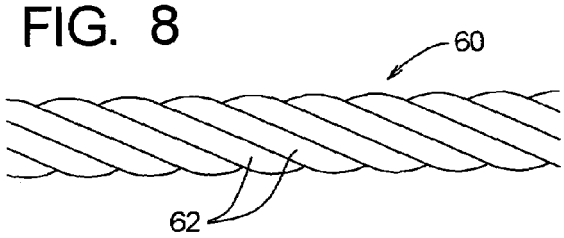
FIG. 8 is a side elevation view of a first example of a rope of the present invention.
Figure 9:
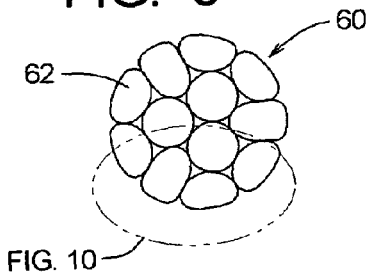
FIG. 9 is a radial cross-section of the rope depicted in FIG. 8.
Figure 10:
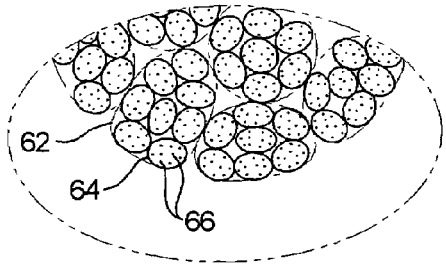
FIG. 10 is a close-up view of a portion of FIG. 9.

Referring now to FIGS. 8, 9, and 10, those figures depict a third example of a rope 60 constructed in accordance with the principles of the present invention. As perhaps best shown in FIG. 6, the rope 60 comprises a plurality of strands 62. FIG. 7 further illustrates that each of the strands 62 in turn comprises a plurality of yarns 64, respectively. The yarns 64 are in turn comprised of a plurality of fibers 66.

The example yarn 64 may be formed by a yarn such as the abrasion resistant yarn 20 described above. The fibers 66 of at least some of the yarns 64 are of a first type and a second type, where the first and second types and correspond to the first and second fibers 24 and 28, respectively.

The strands 62 are formed by combining the yarns 64 using any one of a number of processes. The exemplary rope 60 is formed from the strands 62 using a twisting process. The example rope 60 is thus the type of rope referred to in the industry as a twisted rope.

The strands 62 and yarns 64 forming the rope 60 may be substantially identical in size and composition. However, strands and yarns of different sizes and compositions may be combined to form the rope 60. The first and second types of fibers are combined to form at least some of the yarns 64 are different as described above with reference to the fibers 24 and 28.

FOURTH ROPE EXAMPLE

Figure 11:
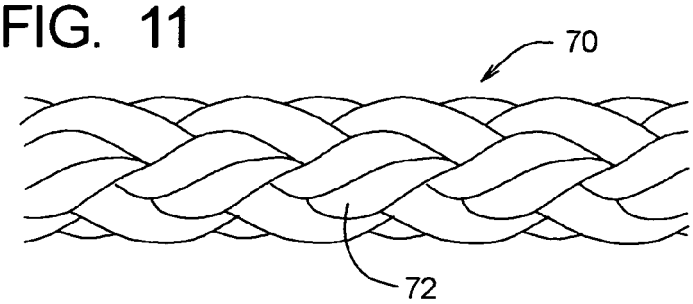
FIG. 11 is a side elevation view of a first example of a rope of the present invention.
Figure 12:
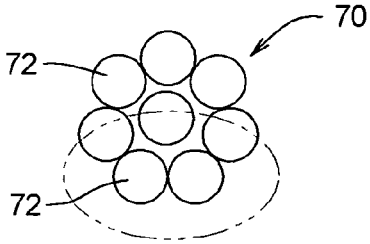
FIG. 12 is a radial cross-section of the rope depicted in FIG. 8.
Figure 13:
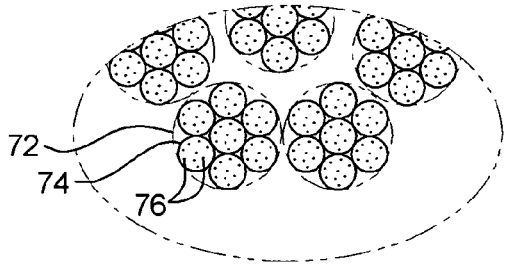
FIG. 13 is a close-up view of a portion of FIG. 9.

Referring now to FIGS. 11, 12, and 13, those figures depict a fourth example of a rope 70 constructed in accordance with the principles of the present invention. As perhaps best shown in FIG. 12, the rope 70 comprises a plurality of strands 72. FIG. 13 further illustrates that each of the strands 72 comprise a plurality of yarns 74 and that the yarns 74 in turn comprise a plurality of fibers 76, respectively.

One or both of the example yarns 74 may be formed by a yarn such as the abrasion resistant yarn 20 described above. In particular, in the example yarns 74 of the example rope 70, the fibers 76 are each of a first type corresponding to the first fibers 24 and a second type corresponding to the second fibers 28.

The strands 72 are formed by combining the yarns 74 using any one of a number of processes. The exemplary rope 70 is formed from the strands 72 using a braiding process. The example rope 70 is thus the type of rope commonly referred to in the industry as a braided rope.

The strands 72 and yarns 74 forming the rope 70 may be substantially identical in size and composition. However, strands and yarns of different sizes and compositions may be combined to form the rope 70. The first and second types of fibers are combined to form at least some of the yarns 74 are different as described above with reference to the fibers 24 and 28.

YARN FABRICATION

Figure 14:
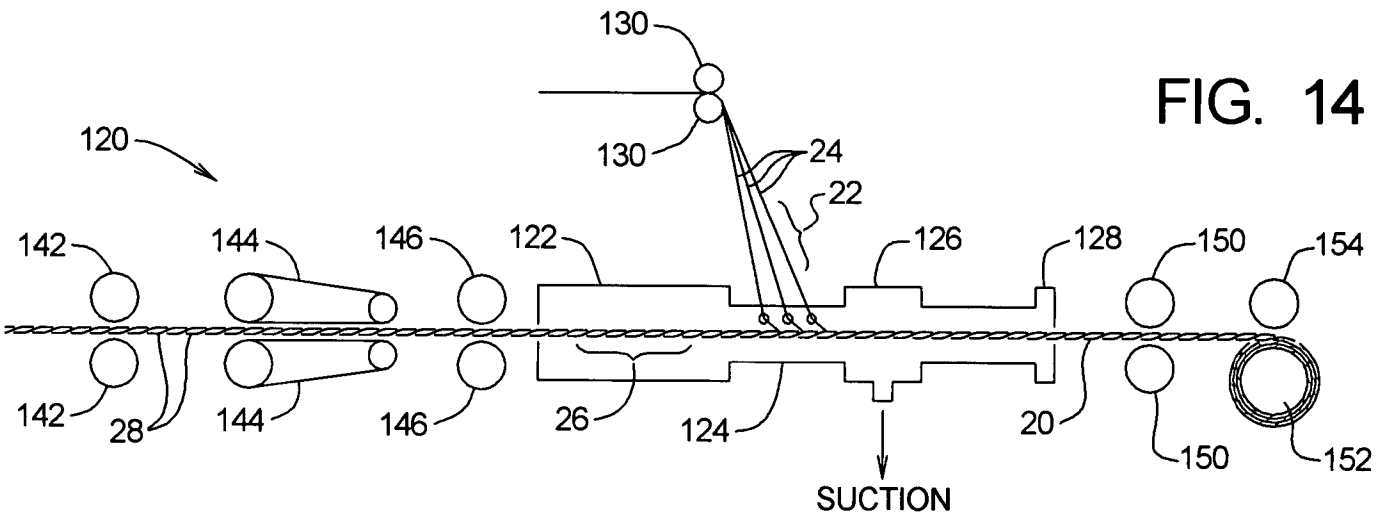
FIG. 14 is a schematic diagram representing an example process of fabricating the yarn depicted in FIGS. 1A and 1B.

Turning now to FIG. 14 of the drawing, depicted at 120 therein is an example system 120 for combining the first and second materials 24 and 28 to form the example yarn 20. The system 120 basically comprises a transfer duct 122, a convergence duct 124, a suction duct 126, and a false-twisting device 128. The first material 24 is passed between a pair of feed rolls 130 and into the convergence duct 124. The second material 28 is initially passed through a pair of back rolls 142, a pair of drafting aprons 144, a pair of drafting rolls 146, and into the transfer duct 122.

The example first fibers 24 are continuous fibers that extend substantially the entire length of the example yarn 20 formed by the system 120. The example second fibers 26 are slivers, or discontinuous fibers that do not extend the entire length of the example yarn 20.

The second fibers 28 become airborne and are drawn into convergence duct 124 by the low pressure region within the suction duct 126. The first fibers 24 converge with each other and the airborne second fibers 28 within the convergence duct 124. The first fibers 24 thus pick up the second fibers 28. The first and second fibers 24 and 28 are then subsequently twisted by the false-twisting device 128 to form the yarn 20. The twist is removed from the first fibers 24 of the yarn 20 as the yarn travels away from the false-twisting device 128.

After the yarn 20 exits the false-twisting device 128 and the twist is removed, the yarn passes through let down rolls 150 and is taken up by a windup spool 152. A windup roll 154 maintains tension of the yarn 20 on the windup spool 152.

FIRST YARN EXAMPLE

A first example of yarn 20*a* that may be fabricated using the system 120 as described above comprises the following materials. The first fibers 24 are formed of HMPE fibers and the second fibers are formed of polyester fibers. The yarn 20*a* of the first example comprises between about sixty to eighty percent by weight of the first fibers 24 and between about twenty to forty percent by weight of the second fibers 28.

SECOND YARN EXAMPLE

A second example of yarn 20*b* that may be fabricated using the system 120 as described above comprises the following materials. The first fibers 24 are formed of LCP fibers and the second fibers are formed of a combination of LCP fibers and Aramid fibers. The yarn 20*a* of the first example comprises between about fifteen and thirty-five percent by weight of the first fibers 24 and between about sixty-five and eighty-five percent by weight of the second fibers 28. More specifically, the second fibers 28 comprise between about forty and sixty percent by weight of LCP and between about forty and sixty percent by weight of Aramid.

Given the foregoing, it should be clear to one of ordinary skill in the art that the present invention may be embodied in other forms that fall within the scope of the present invention.

What is claimed is:

1. A rope adapted to engage a structural member comprising:

a plurality of yarns, where at least one of the yarns comprises a first set of first fibers, where the first fibers extend the length of the rope such that the first fibers directly bear tension loads applied to the rope; and a second set of second fibers, where the first and second sets of fibers are combined using a false twisting process such that the second fibers do not extend the length of the rope, the second fibers indirectly bear tension loads on the rope, and when the rope contacts the structural member, the second set of fibers is primarily in contact with the structural member; wherein the first fibers substantially determine load bearing properties of the rope;

the second fibers substantially determine abrasion resistance properties of the rope, where abrasion resistance properties of the second fibers are greater than abrasion resistance properties of the first fibers; and the second fibers substantially determine a coefficient of friction between the rope and the structural member, where a coefficient of friction of the second fibers is less than a coefficient of friction of the first fibers.

2. A rope as recited in claim 1, in which the second set of fibers at least partly surrounds the first set of fibers.

3. A rope as recited in claim 1, in which the first and second sets of fibers a combined using a process wherein at least some of the fibers of the second set of fibers are wound at least partly around some of the fibers of the first set.

4. A rope as recited in claim 1, in which at least some of the fibers of the first set of fibers are substantially continuous and the fibers of the second set of fibers are substantially discontinuous.

5. A rope as recited in claim 1, in which the fibers of the second set of fibers are at least one fiber selected from the group of fibers consisting of polyester, nylon, Aramid, LCP, and HMPE fibers.

6. A rope as recited in claim 1, in which the fibers of the second set of fibers are polyester fibers.

7. A rope as recited in claim 6, in which the rope comprises about sixty to eighty percent by weight of the first fibers and about twenty to forty percent by weight of the second fibers.

8. A rope as recited in claim 1, in which the fibers of the second set of fibers are LCP and Aramid fibers.

9. A rope as recited in claim 6, in which the rope comprises about fifteen to thirty-five percent by weight of the first fibers and about sixty-five to eighty five percent by weight of the second fibers.

10. A rope as recited in claim 1, in which the fibers of the first set of fibers are HMPE fibers.

11. A rope as recited in claim 1, in which the rope is a double braided rope.

12. A rope as recited in claim 1, in which the rope comprises a core and a jacket.

13. A rope as recited in claim 1, in which the rope is a braided rope.

14. A rope as recited in claim 1, in which the rope is a twisted rope.

15. A rope as recited in claim 1, in which the rope comprises a plurality of fibers combined to form a plurality of yarns, where the plurality of yarns are combined to form a plurality of strands, and the plurality of strands are combined to form the rope.

16. A rope as recited in claim 15, second portion of the rope is formed by at least one of the fibers.

17. A rope as recited in claim 15, second portion of the rope is formed by at least one of the yarns.

18. A rope as recited in claim 15, second portion of the rope is formed by at least one of the strands.

19. A rope as recited in claim 1, in which the first portion of the rope forms a primary strength component of the rope.

20. A method of forming a rope adapted to engage a structural member, the method comprising the steps of:

providing a first set of first fibers;

providing a second set of second fibers;

combining the first and second sets of fibers using a false twisting process to form a rope such that the first fibers extend the length of the rope, and the second fibers do not extend the length of the rope, and the second fibers at least partly surround the first fibers; wherein the first fibers directly bear tension loads applied to the rope and substantially determine load bearing properties of the rope;

when the rope contacts the structural member, the second set of fibers is primarily in contact with the structural member such that the second fibers substantially determine abrasion resistance properties of the rope, where abrasion resistance properties of the second fibers are greater than abrasion resistance properties of the first fibers; and the second fibers substantially determine a coefficient of friction between the rope and the structural member, where a coefficient of friction of the second fibers is less than a coefficient of friction of the first fibers.

21. A method as recited in claim 20, in which the step combining the first and second rope materials comprises the step of forming yarn of the first and second fibers.

22. A method as recited in claim 21, in which the first fibers are formed of HMPE.

* * * * *